United States Patent [19]

DiRosa

[11] 4,301,856

[45] Nov. 24, 1981

[54] PERMANENT MOLD FOR GRAVITY CASTING OF LIGHT ALLOY CYLINDER HEADS

[76] Inventor: Gaetano DiRosa, Strada Torino, 50, Pino Torinese (Torino), Italy

[21] Appl. No.: 84,461

[22] Filed: Oct. 12, 1979

[51] Int. Cl.[3] ..... B22D 33/04

[52] U.S. Cl. ..... 164/340; 164/342; 249/162

[58] Field of Search ..... 164/339–343, 164/137, 303, 312; 249/161, 162

[56] References Cited

U.S. PATENT DOCUMENTS

| | | | |
|---|---|---|---|
| 1,019,905 | 3/1912 | Schilling et al. | 164/340 |
| 1,318,380 | 10/1919 | Hazelett | 164/340 |
| 1,695,001 | 12/1928 | Wood | 164/340 |
| 2,287,524 | 2/1941 | Jackson | 164/340 |
| 2,445,995 | 7/1948 | Bourret et al. | 164/340 |

FOREIGN PATENT DOCUMENTS

| | | | |
|---|---|---|---|
| 1243830 | 7/1967 | Fed. Rep. of Germany | 164/312 |
| 1518262 | 7/1978 | United Kingdom | 164/303 |

*Primary Examiner*—Robert D. Baldwin
*Assistant Examiner*—K. Y. Lin
*Attorney, Agent, or Firm*—Barnes, Kisselle, Raisch & Choate

[57] ABSTRACT

A permanent mold for gravity casting of light alloy cylinder heads comprising a base, a pair of lower platens slidably mounted on the base for movement horizontally toward and away from one another cooperating to define a mold cavity when they are in position adjacent one another, and a tiltable upper platen hinged on each lower platen and movable from a position adjacent and overlying a portion of the platen to a position above the platen. A top core support is adapted to be moved into position on the mold when the lower platens are adjacent one another and the upper platens are pivoted downwardly onto the lower platens. A plurality of inserts are adjustably supported on the top core support and extend downwardly to form corresponding cylinder openings in the casting.

6 Claims, 8 Drawing Figures

PERMANENT MOLD FOR GRAVITY CASTING OF LIGHT ALLOY CYLINDER HEADS

This invention relates to permanent mold casting machines and particularly to permanent molds for gravity casting of light alloy cylinder heads.

BACKGROUND AND SUMMARY OF THE INVENTION

In the permanent mold casting of light alloy cylinder heads, it is common to use a plurality of permanent molds mounted on a turret, the molds being movable successively through a series of stations during which the molds are successively closed, filled, cooled, opened and unloaded. Such molds conventionally comprise a base and two movable platens sliding over the base. In order to permit setting of separate cores or ports in the cylinder head, it is conventional to divide the platen into upper and lower portions that are individually slidable relative to one another. Such an arrangement requires separate sets of guides for the relative sliding portions of the platens and more complex apparatus for moving the platen portions. Accordingly, one of the objectives of the present invention is to provide a more simplified mold construction which obviates the wear problems of prior art permanent molds and eliminates the need for complex operating mechanisms.

In the prior art permanent molds, it is conventional to cast the cylinder heads with the combustion chamber up in order to insure a better filling of molten metal. In such an arrangement, a removable top core is used having a plurality of downwardly extending portions defining the cylinder heads. The top core is subjected to heat distortion and, unless carefully controlled, may result in difficulty in maintaining the proper volumetric tolerances in the combustion chamber. Accordingly, another objective of the present invention is to provide a permanent mold having a novel top core construction which will insure the acceptable tolerances in the volume of the combustion chambers when the mold has reached the working temperature.

Further, in prior art permanent molds, the pouring basin or cavity and runner are generally obtained or provided in the area where the platen joins the bottom plate. In such an arrangement, it is difficult to avoid heat distortions and resultant gaps due to imperfect matching of the platen and bottom plate surfaces. Accordingly, another objective of the present invention is to provide a platen end construction which is independently movable and thereby can be adjusted to obviate the disadvantages of heat distortion.

In the prior art permanent molds, another problem occurs in connection with the movable metal cores that are required for spark plug holes, valve guides, rocking lever supports and the like. Such cores are usually mechanized by an actuator located along the center line of the metal core itself, each core or sets of cores having their own actuators. This arrangement has severe limitations because of the numerous actuators required to be associated with the mold. Accordingly, another objective of the present invention is to provide a permanent mold having a more simplified arrangement of movable cores.

DESCRIPTION

Figure 1:
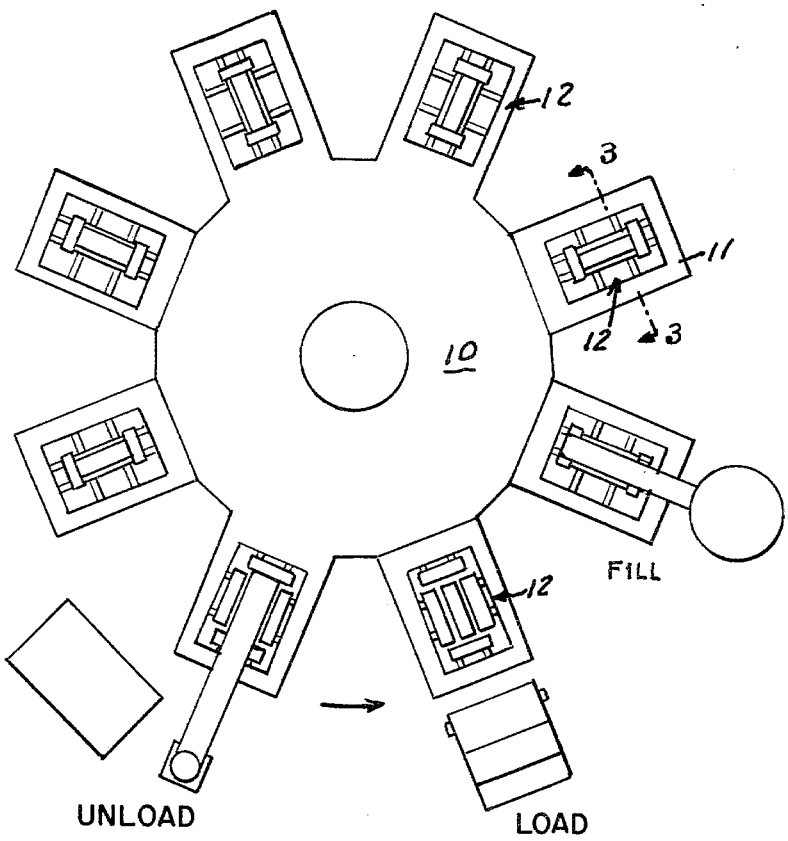
FIG. 1 is a diagrammatic plan view of a casting machine utilizing the permanent mold embodying the invention.

Referring to FIG. 1, the permanent mold embodying the invention is adapted to be used on a permanent mold casting machine which includes a turret 10 having a plurality of circumferentially spaced supports 11 on which permanent molds 12 embodying the invention are provided. The turret 10 is indexed successively through a plurality of stations including a load station at which the inserts and the like are loaded into the mold 12 and the mold is closed, a fill station during which the molten metal is directed to the permanent mold by a fill apparatus 13, a plurality of cooling stations and finally an unload station where the mold is opened so that the cast cylinder head may be removed. The permanent mold casting machine includes cylinders or similar actuating mechanisms at the load and unload station which actuate the portions of the permanent mold to bring them into an out of operative position for molding.

Figure 2:
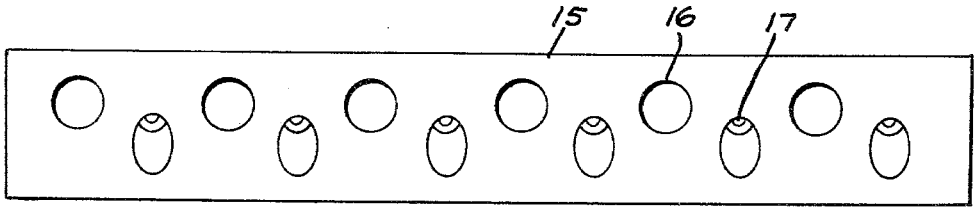
FIG. 2 is a partly diagrammatic plan view of a cylinder head cast in the permanent mold embodying the invention.

FIG. 2 shows a typical cylinder head 15 shown diagrammatically which includes a plurality of openings 16, 17 that form parts of the cylinder head which in turn provide cavities or openings for forming the combustion chamber, spark plug holes, valve guides, rocking lever supports and the like.

Figure 3:
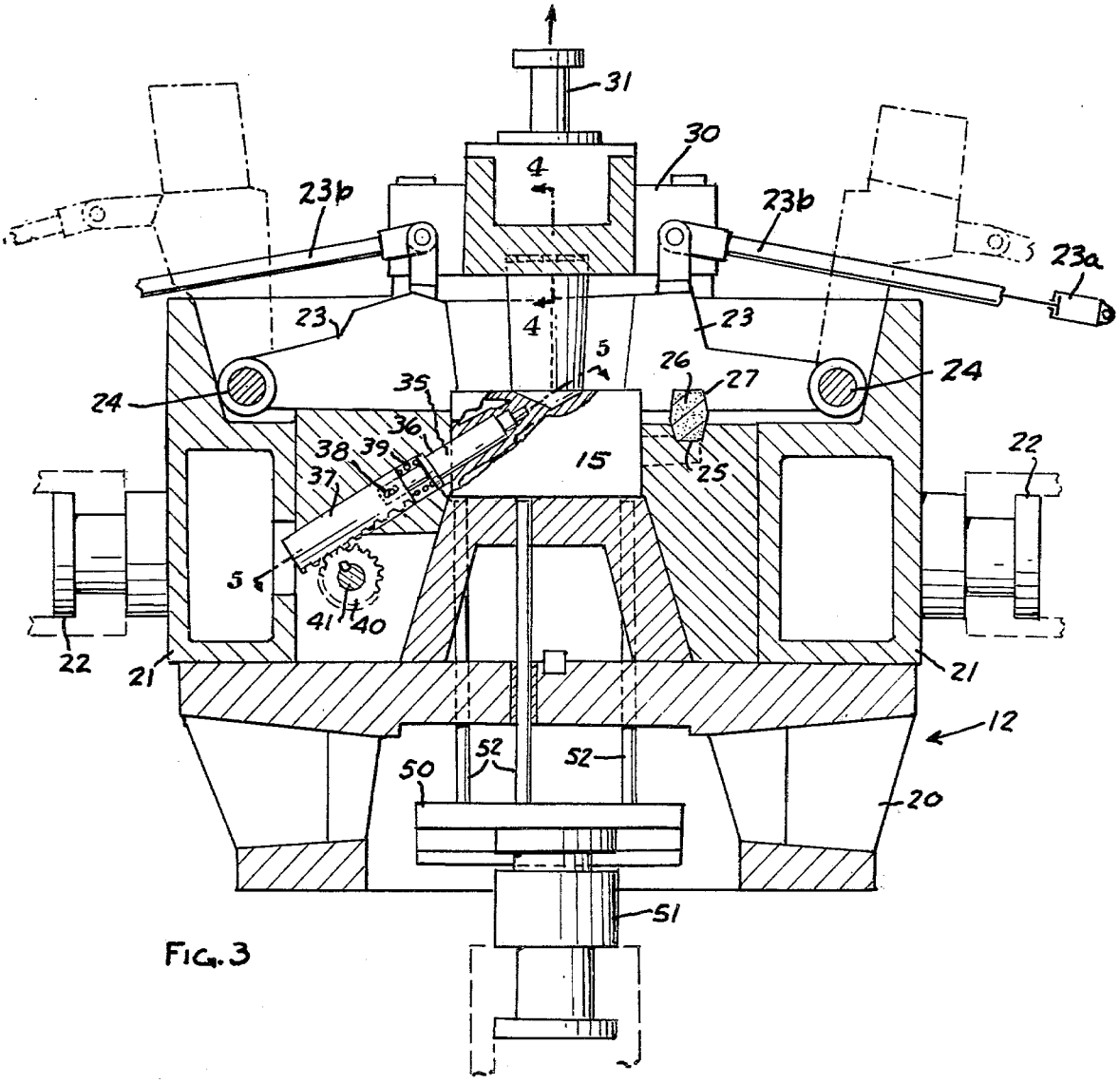
FIG. 3 is a sectional view taken along line 3—3 in FIG. 1 on an enlarged scale, parts being broken away.

Referring to FIG. 3, each permanent mold comprises the base which has guides on the upper surface thereof for supporting lower platens 21 that are movable horizontally toward and away from one another to define the mold cavity. Each lower platen 21 includes a connector 22 for connection to the operating cylinders at the appropriate station of the permanent molding machine. An upper platen 23 is hinged as at 24 to each lower platen 21. Each upper platen 23 is moved into position, shown in solid lines in FIG. 3, and out of position, shown in broken lines in FIG. 3, by a hydraulic cylinder 23*a* which has its shaft 23*b* pivoted to its respective platen. At least one of the lower platens 21 has one or more recesses or seats 25 for receiving removable cores 26. The cooperating upper platen 23 has complementary recesses 27 for engaging the cores 26 and maintaining them in position.

By hinging the upper platen 23 to the lower platen 21, rather than having them independently movable, the necessity for having separate guides between the upper and lower platen members is eliminated, the mechanism for operating the upper and lower platens is simplified and it is possible to provide bosses, flanges or protruding edges with undercut portions in the casting.

Figure 4:
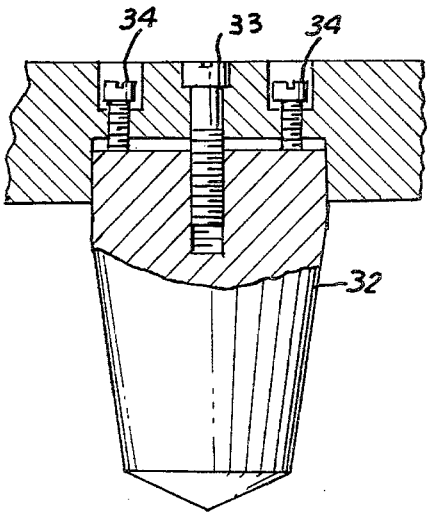
FIG. 4 is a fragmentary sectional view on an enlarged scale taken along line 4—4 in FIG. 3.
Figure 5:
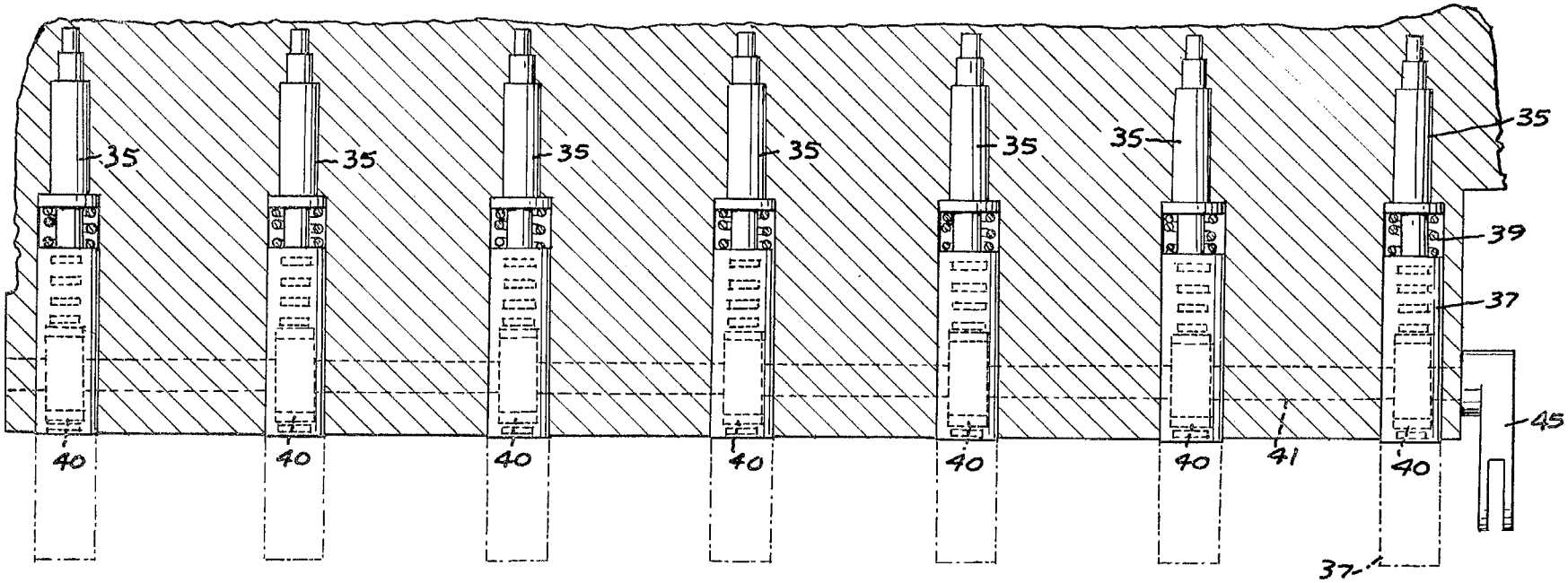
FIG. 5 is a fragmentary sectional view on an enlarged scale taken along line 5—5 in FIG. 3.

The permanent mold 12 further includes a removable top core support 30 which has a portion 31 so that it can be engaged and removed as well as repositioned at the unloading station. The top core support 30 supports the plurality of downwardly extending inserts 32 which cooperate with the remainder of the mold to define the combustion chambers of the cylinder head (FIG. 4). Each insert 32 is adjustable individually with respect to the support 30 by an arrangement which includes the bolt 33 extending through the support 30 into the insert and threaded into the insert locking screws 34 threaded in the support 30 and engaging the insert 32. In this fashion, it is possible to adjust and hold each insert 32 so that it is in proper relationship to the remainder of the mold insuring proper and accurate volumetric control of the combustion chamber.

Figure 6:
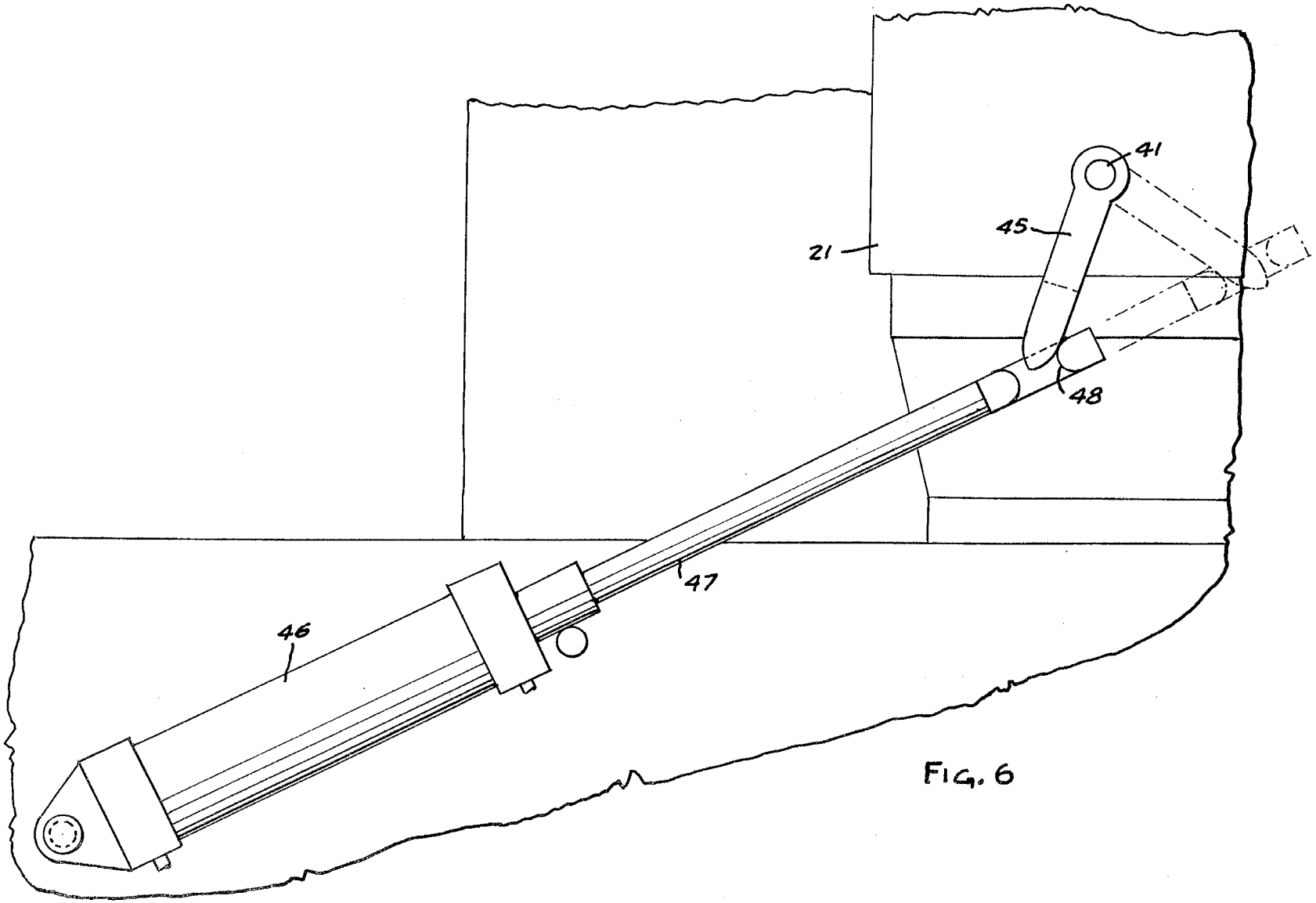
FIG. 6 is a fragmentary end view of a portion of the mold.

The permanent mold 12 further includes a plurality of longitudinally spaced movable cores 35 slidable in openings 36. Each core has lost motion connection with a rack 37 through a pin and slot arrangement 38 which provides limited relative movement between the core and rack. The spring 39 yieldingly urges the core outwardly into the mold cavity. Each rack 37 engages a pinion 40 on a shaft 41 journaled in the platen 21. By rotation of the shaft portion 41, the cores 35 are simultaneously moved into the cavity or retracted. The mechanism for rotating the shaft 41 is mounted on the casting machine at the appropriate stations, for example, the loading and unloading station. As shown in FIG. 6, this mechanism comprises a cylinder 46 that has an arm 47 thereon with an opening 48 adapted to engage a lever 45 on the end of the shaft 41. At the appropriate station, the cylinder 46 is energized to cause the arm 47 to engage the lever 45 and rotate the shaft 41 moving the cores 35 into and out of operative position.

The permanent mold further includes an ejector mechanism which includes an ejector plate 50 having a connector 51 for attachment to an appropriate cylinder at the unloading station and a plurality of ejection pins 52 that are movable upwardly through the base 20 to engage the cylinder head and eject it out of the mold (FIG. 3).

Figure 7:
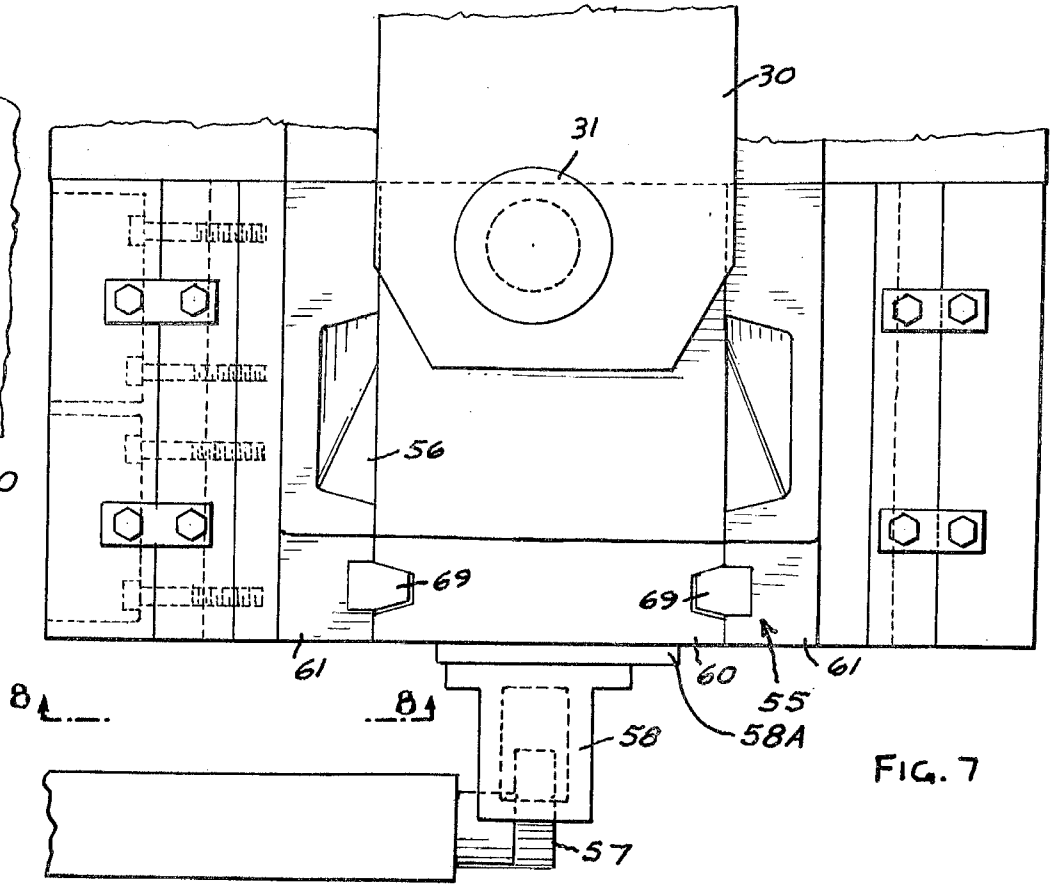
FIG. 7 is a fragmentary plan view of a portion of the permanent mold shown in FIG. 3.

As shown in FIG. 7, the permanent mold includes end platens 55 at each end, one of which is formed with filling openings 56. An end block 58A is adapted to be moved into and out of position by a mechanism at the appropriate station which includes a hydraulically operated lever 57 which is adapted to engage a connector 58 on the end block 58A. The same type of construction may be present at the opposite end of the mold.

Figure 8:
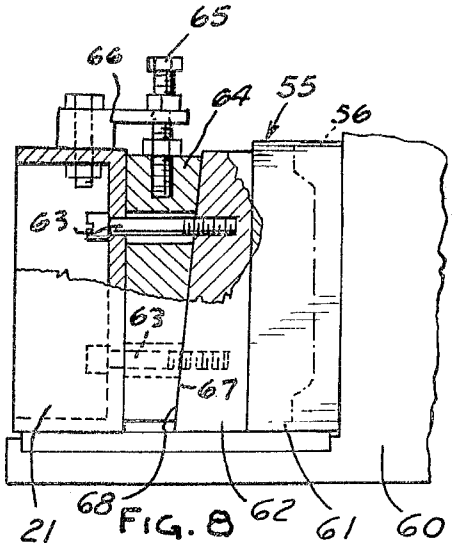
FIG. 8 is a fragmentary view taken along line 8—8 in FIG. 7.

As shown in FIGS. 7 and 8, each end platen is formed with an adjustable side part 61 that cooperates with the fixed part of the mold 60 to form the filling opening 56. In order to prevent gaps and leakage of the molten metal during the filling of the mold, each side part is adjustable by an arrangement such as shown in FIG. 8, which includes a first member 62 engaging in side part 61 and supported on adjacent lower platen 21 by bolts 63. A second part 64 is supported between lower platen 21 and first part 62 by a vertical bolt 65. In turn, vertical bolt 65 is supported on a bracket 66 mounted on lower platen 21. Part 64 has enlarged openings therethrough through which bolts 63 extend so that part 64 has limited relative vertical movement with respect to part 62. Parts 62, 63 have cooperating inclined surfaces 67, 68. By adjusting the bolt 65 and the lock nuts thereon, the vertical position of the part 64 can be adjusted, thereby clamping the part 62 against the adjustable part 61 of the end platen as may be required to prevent leakage of molten metal that could occur through gaps caused by heat distortion. Prevention of leakage is facilitated also by inserts 69 in complementary grooves between the central part 60 and end parts 61 of end platen 55. Similar inserts are preferably provided between the bottom of the end platen and the base 20.

I claim:

1. A permanent mold for gravity casting of light alloy cylinder heads comprising, a base, a pair of lower platens slidably mounted on said base for movement horizontally toward and away from one another cooperating to define a mold cavity when they are in position adjacent one another, means on said platens adapted to be selectively engaged by actuating mechanisms associated with the casting machine for moving said platens into and out of position, end blocks associated with said platens, at least one said end block having an adjustable portion movable horizontally toward and away from the platens, said portion having the metal runner therein through which the molten metal is introduced.

2. The permanent mold set forth in claim 1 including an insert, said end block and said base having grooves therein, said insert engaging said grooves in said end block and said base, said insert and said grooves cooperating to maintain the platen and base in tight relationship.

3. The permanent mold set forth in claim 1 including adjustable means comprising parts which are relatively vertically displaceable, one of which engages the adjustable portion of the end block and the other of which engages a lower platen to hold said end block on its respective platen.

4. The permanent mold set forth in claim 3 wherein said end block comprises multiple parts which can be moved horizontally so that they can be clamped together.

5. A permanent mold for gravity casting of light alloy cylinder heads comprising a base, a pair of lower platens slidably mounted on said base for movement horizontally toward and away from one another and cooperating to define a mold cavity when they are in position adjacent one another, a tiltable upper platen hinged on each lower platen and movable from a position adjacent and overlying a portion of the lower platens to a position above the lower platens, at least one lower platen having one or more core seats therein, the upper platen associated with said last-mentioned lower platen having recesses therein engaging said cores, a top core support adapted to be moved into position on said mold when said lower platens are adjacent one another and said upper platens are pivoted downwardly onto said lower platens, said top core support having at least one insert extending downwardly into the cavity when in position on said mold for forming a corresponding cylinder opening in the casting, and means on said platens and said top core support adapted to be selectively engaged by actuating mechanisms associated with the casting machine for moving said platens and said top core support into and out of position, end blocks associated with said lower platens, at least one said end block having an adjustable portion movable horizontally toward and away from the platens, said portion having the metal runner therein through which the molten metal is introduced.

6. The permanent mold set forth in claim 5 including an insert, said end block and said base including grooves, said insert engaging said grooves in said end block and said base, said insert and said grooves cooperating to maintain the platen and base in tight relationship.

* * * * *